US005615692A

United States Patent [19]

Ruppert et al.

[11] Patent Number: 5,615,692

[45] Date of Patent: Apr. 1, 1997

[54] METHOD AND APPARATUS FOR FILLING CIGARETTE-PAPER TUBES WITH TOBACCO

[75] Inventors: Heinrich W. Ruppert; Gunter Schütze; Klaus G. Gätschmann, all of Trossingen, Germany

[73] Assignee: EFKA-Werke Fritz Kiehn GmbH, Germany

[21] Appl. No.: 681,619

[22] Filed: Jul. 29, 1996

Related U.S. Application Data

[63] Continuation of Ser. No. 351,791, Dec. 8, 1994, abandoned.

[30] Foreign Application Priority Data

Dec. 23, 1993 [DE] Germany ..... 43 44 281.1
Jan. 5, 1994 [DE] Germany ..... 44 00 192.4

[51] Int. Cl.[6] ..... A24C 5/00; A24C 5/42

[52] U.S. Cl. ..... 131/70

[58] Field of Search ..... 131/70, 72, 280

[56] References Cited

U.S. PATENT DOCUMENTS

| | | | |
|---|---|---|---|
| 3,783,882 | 1/1974 | Messner et al. | 131/70 |
| 4,620,551 | 11/1986 | Ruppert et al. | 131/70 X |
| 5,009,237 | 4/1991 | Schmidt et al. | 131/70 |
| 5,018,536 | 5/1991 | Liebich | 131/70 |
| 5,088,506 | 2/1992 | Kastner | 131/70 |
| 5,398,701 | 3/1995 | Neumann et al. | 131/70 |

FOREIGN PATENT DOCUMENTS

| | | | |
|---|---|---|---|
| 1079394 | 11/1954 | France | 131/70 |
| 2833681 | 2/1980 | Germany . | |
| 3149584 | 12/1981 | Germany . | |
| 8309186 | 3/1983 | Germany . | |
| 8326921 | 11/1983 | Germany . | |
| 3244906 | 6/1984 | Germany . | |
| 3343407 | 6/1985 | Germany . | |
| 6703935 | 3/1967 | Netherlands . | |
| 192362 | 1/1938 | Switzerland | 131/70 |

*Primary Examiner*—Jennifer Bahr
*Attorney, Agent, or Firm*—Andrus, Sceales, Starke & Sawall

[57] ABSTRACT

A method and apparatus for filling or packing cigarette-paper tubes is described wherein the apparatus comprises at least one tobacco-transfer means, in the form of a plunger or the like is mounted on a housing so as to be axially displaceable to transfer at least one tobacco strand out of a strand casing disposed within the housing into an associated cigarette-paper tube. At least one nozzle is mounted on the housing to which the open end of the cigarette-paper tube is connected in such a way that during transfer the tobacco passes through the nozzle into the associated tube. Within the housing is defined a receptacle in which at least one tobacco-filled strand casing is disposed and within which the strand casing is held and externally supported so that it cannot be displaced during transfer of the tobacco strand into the cigarette-paper tube.

25 Claims, 8 Drawing Sheets

METHOD AND APPARATUS FOR FILLING CIGARETTE-PAPER TUBES WITH TOBACCO

CROSS REFERENCE TO RELATED APPLICATION

This application is a file wrapper continuation of application Ser. No. 08/351,791, filed Dec. 8, 1994 now abandoned.

FIELD OF THE INVENTION

The present invention relates to a method and an apparatus for the filling or packing of cigarette-paper tubes with tobacco. In addition, the present invention relates to a handling unit of strand casings suitable for use with said apparatus.

DESCRIPTION OF THE PRIOR ART

A number of methods for the user-preparation of cigarettes have long been known. Perhaps best-known is the "roll-your-own" method employing sheets of cigarette paper with adhesive along one edge. To roll one's own cigarette requires a degree of manual dexterity and is time-consuming.

The cigarettes produced even by skilled rollers vary widely in size (diameter), firmness (tightness of filling) and distribution of the filling over the length of the cigarette, so that they are but a primitive replacement for industrially manufactured cigarettes. Another disadvantage of rolling cigarettes by hand is that the tobacco must be crumbled, inevitably with some waste. The same problems, though reduced to some extent, are associated with the use of cigarette-rolling devices. It was evidently in the hope of making it easier to roll one's own cigarette that a tobacco product according to NL-H6703935 was provided, which consists of a tobacco portion matched to the tobacco filling of a finished cigarette, the outer surface of which is formed by a sheath of material completely consumable by smoking but air-pervious so that the tobacco portion as such cannot be smoked like a cigarette. It was intended that a conventional sheet of cigarette paper be wrapped around this tobacco portion and glued together in the known manner to produce a smokable cigarette.

A fundamentally different means of producing one's own cigarettes is to pack a previously formed tube. There are a number of conventional devices for packing empty tubes of cigarette paper (ordinarily including a filter piece) with tobacco. All those in general use comprise an elongated pressing chamber delimited on one side by an approximately hemicylindrical fixed wall element and on the other side by an oppositely hemicylindrical surface of a movable pressing bar, by means of which the pressing chamber can be closed after it has been filled with tobacco, producing a strand-like tobacco supply. At the one end of the pressing chamber there is provided an attachment nozzle over which an empty cigarette tube can be slipped to hold it in place. At the opposite end the pressing chamber is delimited by a piston-like tobacco-expelling slide, by means of which the tobacco supply can be transferred from the pressing chamber into the cigarette tube. Such an apparatus is described in, for example DE 2 833 681. These known packing devices have proved more or less satisfactory in practice. However, they have the disadvantage that when the pressing chamber is filled, the user's hands and the surroundings inevitably become soiled to a certain extent with tobacco crumbs or remnants, which are sometimes regarded as disturbing and often dissuade people from using such a device. Finally, because of the manual filling it is impossible for the pressing chamber, and hence the cigarette tube, always to be filled uniformly. Cigarettes packed by the user in this way are thus characterized by variable performance during smoking, i.e. differences in drawing, taste, and time for complete consumption. In this regard the user-packed cigarette behaves like the user-rolled cigarette.

Furthermore, the content of noxious substances in cigarettes conventionally user-packed or user-rolled also varies greatly and cannot be known, as it depends on the varying degrees to which the cigarette tube is filled.

To eliminate these deficiencies in the area of cigarette packing, in both DE-U-83 26 921 and DE-U-83 09 186, as well as in DE-C-33 43 407, there is proposed a tobacco product for user-prepared cigarettes characterized by a prefabricated element not smokable as such, in the form of a factory-prefabricated tobacco cartridge comprising a strand casing open at one end surface, the diameter of which is matched to that of the cigarette-paper tube enclosing finished cigarettes, and a strand-like tobacco filling corresponding to one cigarette portion, which can be transferred out of the strand casing into an empty cigarette-paper tube by means of an associated piston matched in size to the inside diameter of the strand casing. This tobacco product is suitable for use both in connection with conventional user-packed cigarette tubes and in connection with conventional user-rolled cigarette-paper sheets. According to the basic concept of this proposal, the user is provided with a precisely measured amount of tobacco, namely the amount used to fill a conventional, factory-made cigarette ready for consumption, in the form of a tobacco cartridge, the tobacco filling of which can be transferred to a prefabricated cigarette tube of the commercially available kind. Although this latter proposal represents a quite considerable improvement over the described state of the art, the fact cannot be ignored that a relatively high degree of dexterity is required to handle the associated apparatus. In particular, it is necessary to introduce the attachment nozzle at one end of the tobacco-filled strand casing into the latter. This procedure involves the risk that the associated end of the strand casing will be torn open or otherwise damaged, so that the corresponding tobacco portion is no longer usable.

Furthermore, as a result of the introduction of the attachment nozzle, the tobacco is additionally compressed, at least in this region, as a result of which it may be more difficult to transfer the tobacco into the tobacco-receiving space within the empty cigarette-paper tube.

SUMMARY OF THE INVENTION

The object of the present invention is to provide an improved method and an apparatus over the last-described system with respect both to ease of operation and to quality of the tobacco transferred into the cigarette-paper tube. It is also an object of the present invention to provide a tobacco handling unit which is suited for use in connection with the aforementioned apparatus and method in accordance with the invention.

According to a first aspect of the present invention there is provided a method of filling or packing a cigarette-paper tube with tobacco in which a pre-portioned tobacco strand contained within a strand casing is transferred from the strand casing into a cigarette-paper tube comprising the steps of positioning an open end of a cigarette-paper tube adjacent an end face of a tobacco-filled strand casing; pushing the tobacco strand out of the strand casing and into the associated cigarette-paper tube using a plunger means; and at least partially radially supporting the strand casing during at least the transfer process.

According to a second aspect of the present invention there is provided apparatus for filling or packing cigarette-paper tubes with tobacco comprising a housing defining a receptacle for accommodating at least one strand casing filled with a pre-portioned tobacco strand; at least one nozzle associated with the housing to which an open end of a cigarette paper tube can be attached; at least one plunger means mounted on the housing so as to be axially displaceable to transfer said at least one tobacco strand out of the strand casing, through the nozzle and into an associated cigarette-paper tube which is attached to the nozzle; and means within the receptacle for externally and radially supporting said strand casing so that it is not displaced during transfer of the tobacco strand into the cigarette-paper tube.

According to a third aspect of the present invention there is provided a plurality of tobacco-filled strand casings for use with an apparatus according to the second aspect of the present invention, in which the strand casings are held together by connectors each formed by a strip of material that extends along at least one side of at least two strand casings which are arranged side by side in parallel with one another.

As a result of the invention, it is no longer necessary to introduce a nozzle into the tobacco-filled strand casing at one of its ends. In this regard the method in accordance with the invention is consistent with the conventional packing of cigarettes by means of the conventional packing devices. On the other hand, however, the present invention ensures that each cigarette produced by the method in accordance with the invention or by employment of the apparatus in accordance with the invention is uniform with respect to its tobacco filling, smoking characteristics, taste and content of toxic substances.

Surprisingly, for the transfer of tobacco into a cigarette-paper tube it suffices to support the strand casing radially, i.e. at its outer circumference. By this relatively simple measure the strand casing is prevented from bending or crumpling as the tobacco is transferred. The strand casing in this arrangement amounts to an extremely simple substitute for the tobacco-pressing chamber of a conventional packing device.

The present invention will be now be described by way of example with reference to the accompanying drawings.

DESCRIPTION OF THE PREFERRED EMBODIMENTS

Figure 1:
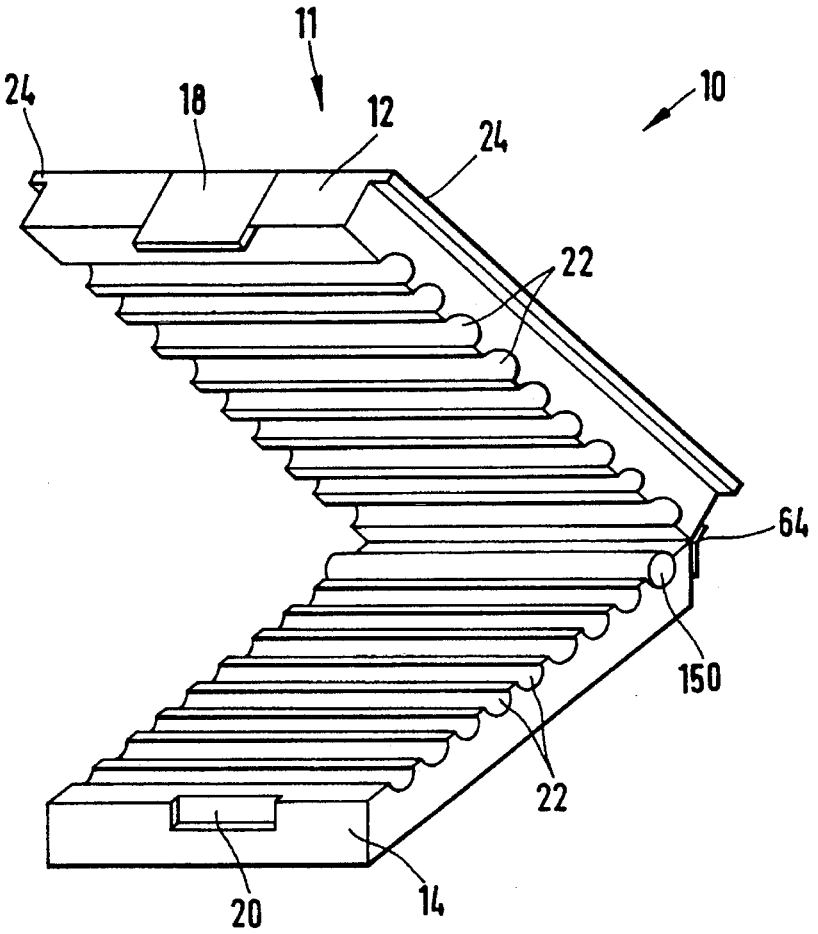
FIG. 1 is a schematic perspective view of a first embodiment of an apparatus in accordance with the invention when in an opened state.
Figure 2A:
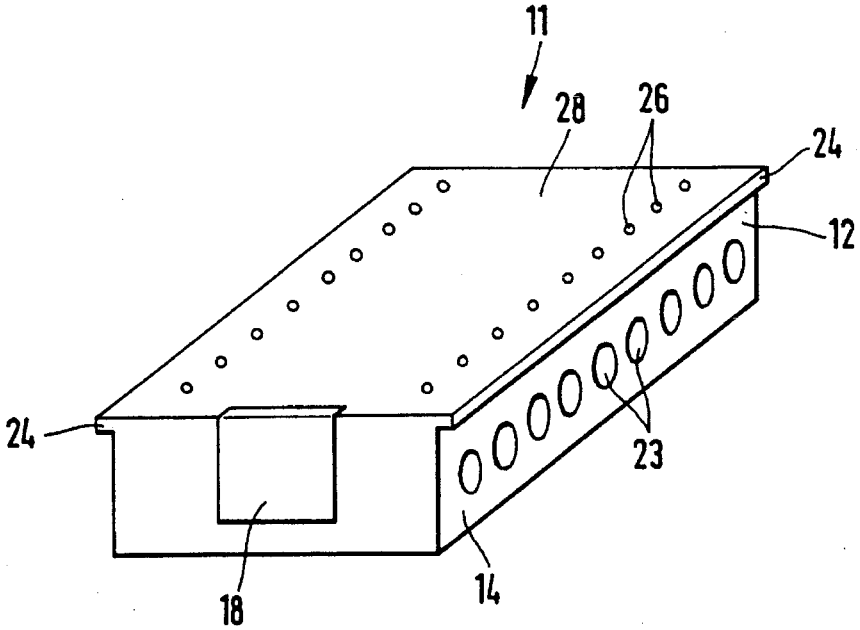
FIG. 2*a* is a schematic perspective view of the apparatus shown in FIG. 1 when in a closed state.
Figure 2B:
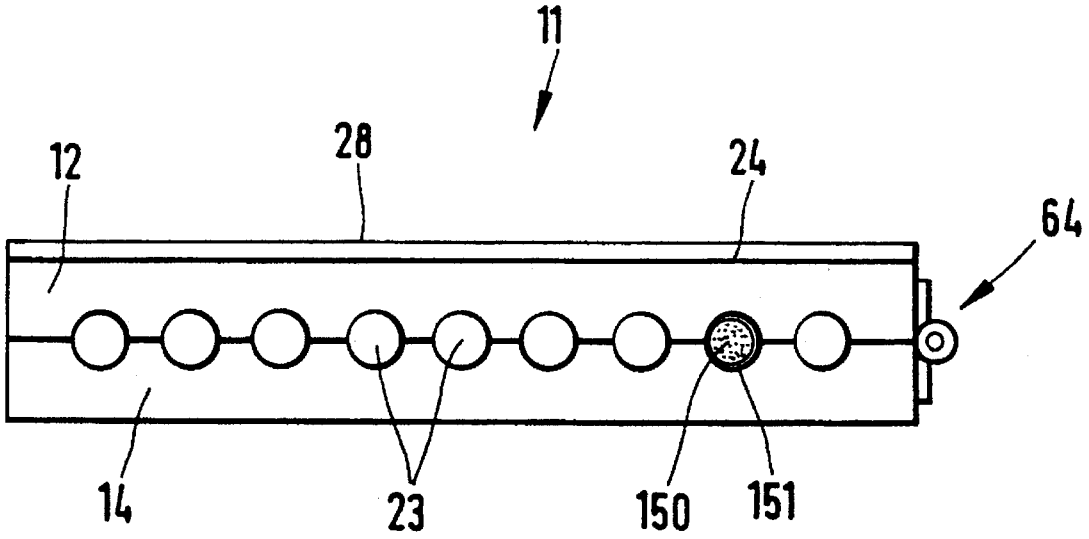
FIG. 2*b* is a side view of the apparatus shown in FIG. 2*a*.

In FIGS. 1 to 12 identical reference numerals are used to identify the same or corresponding parts or characteristics of the various embodiments of apparatus according to the invention.

FIGS. 1 to 5 show a first embodiment of an apparatus 10 for filling or packing with tobacco a cigarette-paper tube (not shown). This apparatus 10 comprises a housing with a lower housing part 14 and an upper housing part 12. The two housing parts 12, 14 are connected to one another on one side in a joint-like or hinge-like manner. The hinge joint is identified by the reference numeral 64. Accordingly, the two housing parts 12, 14 can be opened (FIG. 1) and folded together. In the closed state the two housing parts 12 and 14 are precisely aligned one atop the other, forming a flat block (FIG. 2*a* and 2*b*).

On the side of the upper housing part 12 opposite the hinge joint 64 is disposed a catch plate 18 under spring tension, which in the closed state cooperates with a catch recess 20 in the lower housing part 14, so that when the housing 11 is in the closed state the two housing parts 12, 14 are held together in this state.

As is clearly visible in FIG. 1, each of the housing parts 12, 14 bears on the surface that faces the other part an array of grooves 22 set off from one another by ridges. The grooves 22 run parallel to the axis of the hinge joint 64, and each is semicircular in cross section. Each groove 22 on the inner surface of the lower housing part 14 is associated with a groove 22 on the inner surface of the upper housing part 12. The same applies to the ridges between the grooves 22. When the housing parts 12 and 14 are folded together, each pair of opposed grooves 22 forms a receptacle 23 which is approximately circular in cross section. The inside diameter of the receptacles 23 are substantially the same, each being approximately the same as the outside diameter of a tobacco-filled strand casing 150. The strand casing 150 contains an amount of tobacco corresponding to the amount in a conventional cigarette. The inside diameter of the strand casing 150 corresponds approximately to the inside diameter of a tobacco-receiving space within a prefabricated cigarette-paper tube. Accordingly, the tobacco or tobacco strand within the strand casing 150 can be transferred from the latter into the tobacco-receiving space of an associated cigarette-paper tube substantially without any change in diameter. The length of the strand casing 150 or of the tobacco strand it holds together can be the same or, preferably, somewhat greater than the length of the tobacco-receiving space of the associated cigarette-paper tube. Because the said tobacco portion, consisting of strand casing 150 and tobacco filling or tobacco strand 151, on the one hand and the associated cigarette-paper tube on the other are known system elements, there is no need to describe these elements in detail here. It should merely be mentioned that the strand casing 150 can comprise either smokable or non-smokable material. In either case the strand casing must be air-pervious, e.g. perforated, so that the tobacco strand cannot be smoked unless it is enclosed in a cigarette-paper tube.

When the housing 11 is in the opened state, tobacco-filled strand casings 150 can be set into the grooves 22 of the lower housing part 14. After all or some of the grooves 22 in the lower housing part have been filled with a tobacco-filled strand casing 150, the housing 11 is folded together. In this state the strand casings 150 are supported against the inner walls of the opposed grooves 22, i.e. the receptacles 23 formed by each pair of opposed grooves. To retain the strand casings 150 more firmly within the receptacles 23 formed by the grooves 22, the surfaces of the grooves 22 can be roughened. At their ends, the receptacles 23 formed by the grooves 22, like the strand casings 150, are open. On the upper surface 28 of the upper housing part 12 two parallel rows of spaced-apart troughlike depressions 26 are formed. The two rows of troughlike depressions 26 each extend approximately perpendicular to the long direction of the grooves 22 and hence of the receptacles 23 defined by the grooves 22. The distance separating the troughlike depressions 26 from one another corresponds to the distance between the central long axes of the receptacles 23 defined by the grooves 22.

Figure 3:
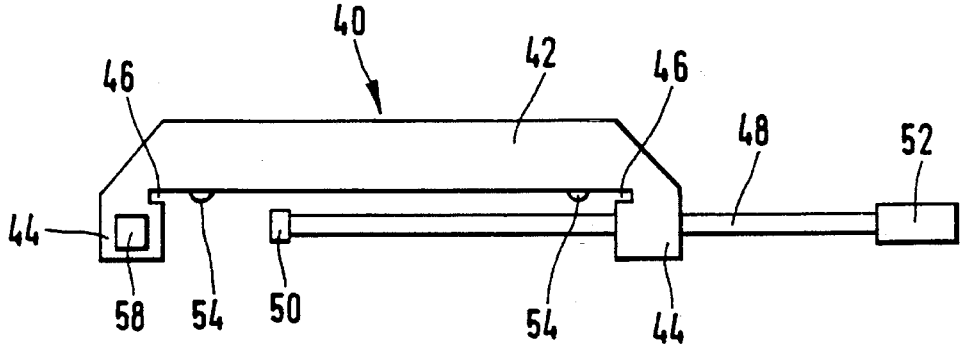
FIG. 3 is a schematic side view of a tobacco-transfer device.
Figure 4:
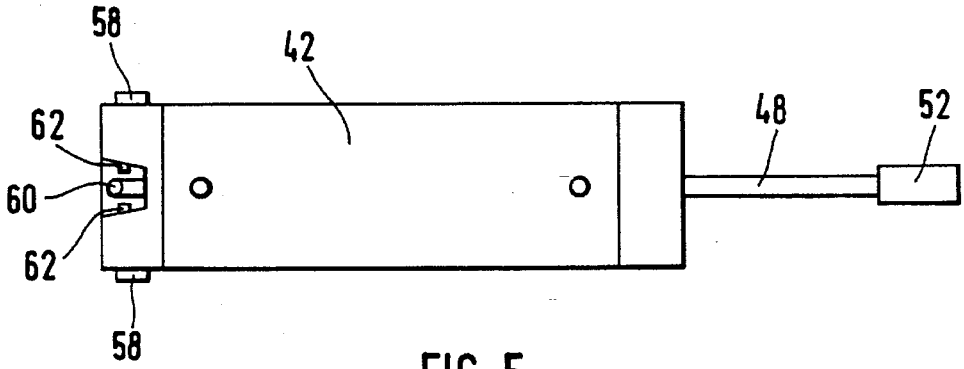
FIG. 4 is a plan view of the tobacco-transfer device shown in FIG. 3.
Figure 5:
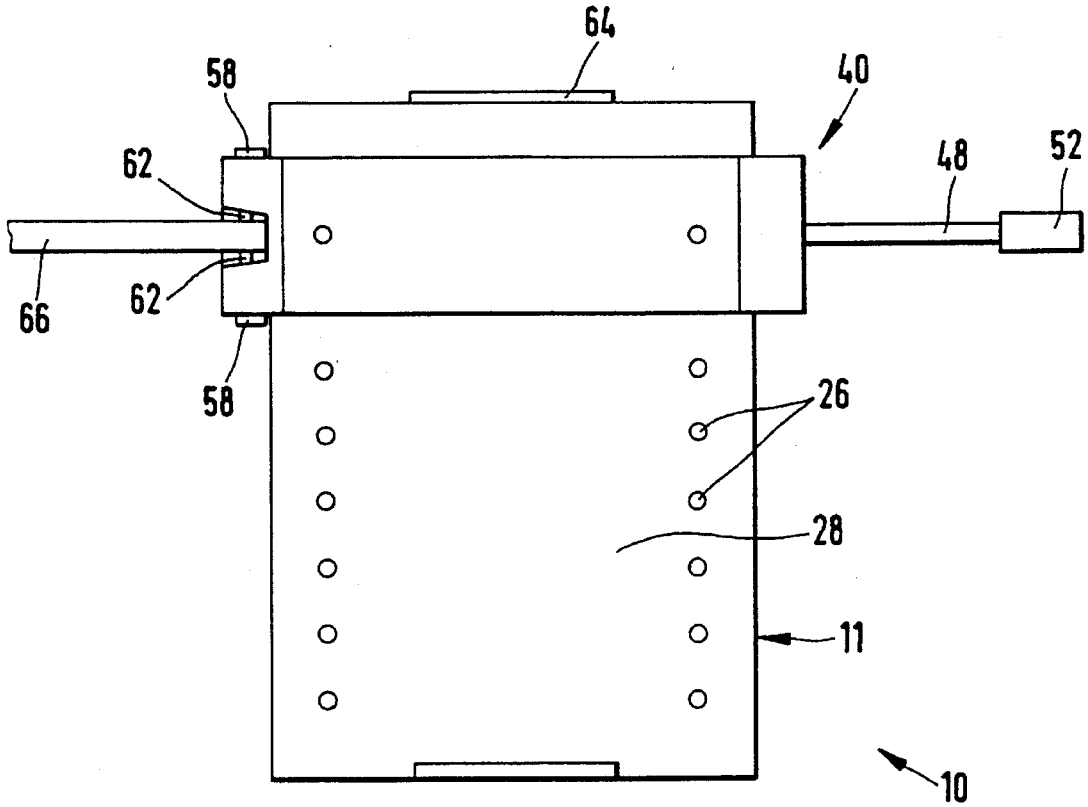
FIG. 5 is a plan view of the apparatus shown in FIGS. 1 and 2 in association with the tobacco-transfer device shown in FIGS. 3 and 4.

In addition, the upper housing part 12 comprises two guide rails 24, each of which extends parallel to the two rows of troughlike depressions 26 and hence is likewise perpendicular to the central long axes of the receptacles 23. These guide rails 24 serve to retain and guide longitudinally a tobacco-transfer device 40 as shown in FIGS. 3, 4 and 5, which can be set onto the upper housing part 12. The tobacco-transfer device 40 is an approximately U-shaped component with a bridge 42 from which there extend at right angles two side pieces 44 with guide slots 46 recessed into their inner, facing surfaces that cooperate with said guide rails 24 on the upper housing part 12 of the housing 11. By this means the tobacco-transfer element 40 can be slid along the guide rails 24 on the upper housing part 12.

In one side piece 44, namely the one shown on the right in FIGS. 3 and 4, a rod 48 is so mounted that it can be displaced axially, parallel to the bridge 42. The rod 48 at its inner end, i.e. the end toward the opposite side piece 44, bears a plunger 50, which is slightly smaller in diameter than the inside diameter of a strand casing 150. At the opposite, outer end a handle 52 is disposed, by means of which the rod 48 can be displaced axially.

The other side piece 44, namely the one shown on the left in FIGS. 3 and 4, defines a bore aligned with the rod 48 and plunger 50 and with an inside diameter which is somewhat larger than the outside diameter of the plunger 50. This bore is continuous at its outer end with an attachment nozzle 60. As shown in FIG. 4, the attachment nozzle 60 is disposed within a recess that is accessible from above, so that a cigarette-paper tube can readily be pushed onto the attachment nozzle 60 in the conventional manner. Furthermore, the attachment nozzle 60 is provided in the conventional way with a clamping mechanism to secure an attached cigarette-paper tube. This clamping mechanism, in a conventional manner, comprises clamp pegs 62 arranged diametrically with respect to the attachment nozzle 60, with an externally accessible press-key 58. The clamp pegs 62 with the press-key 58 can be pressed against the attachment nozzle 60 against the action of a resilient element, such as a spring.

On the inner surface of the bridge 42 of the tobacco-transfer device 40, which faces the upper surface 28 of the upper housing part 11, there are disposed under spring-loading two ball elements 54, which are each associated with one of the two rows of troughlike depressions 26 on the upper surface 28 of the upper housing part 11 and which cooperate with the troughlike depressions 26 to produce a catch connection. By means of the cooperation between the ball elements 54 and the troughlike depressions 26, the tobacco-transfer device can be positioned exactly with respect to the individual receptacles 23 or the strand casings 150 placed within them, so that both the rod 48 with plunger 50 and the attachment nozzle 60 disposed opposite it are aligned with the selected tobacco receptacle 23 and hence with the strand casing 150 it contains.

After some or all of the receptacles 23 have been filled with a tobacco portion of the kind described above and the housing 11 has been closed, the tobacco-transfer device 40 is positioned in association with the receptacles 23 or strand casings 150 in succession. At each consecutive position a cigarette-paper tube is set onto the attachment nozzle 60 in the conventional manner and held there by means of the clamp pegs 62. Then the rod 48 with the plunger 50 is pushed axially into the housing by means of the handle 52, so that it enters the corresponding receptacle 23. By means of the plunger 50 the tobacco or tobacco strand contained in the strand casing 150 is transferred through the attachment nozzle 60 into the cigarette-paper tube, i.e. into its tobacco-receiving space. The rod 48 with plunger 50 is thereupon pulled back again by its handle 52 until the plunger 50 is far enough out of the housing 11 so as not to collide with it. The tobacco-filled cigarette is withdrawn from the attachment nozzle in the conventional manner after the clamp pegs 62 have been released. Then the tobacco-transfer device 40 is slid along the guide rails 24 until it catches in the next position, where the rod 48 with plunger 50 and the attachment nozzle 60 are aligned with the next receptacle 23, which contains a tobacco-filled strand casing or tobacco portion. After all the strand casings have been emptied, to produce a corresponding number of cigarettes, the housing 11 is opened again. The empty strand casings 150 are removed. The procedure just described can be repeated from the beginning, until the user has prepared a sufficient number of cigarettes.

Figure 6:
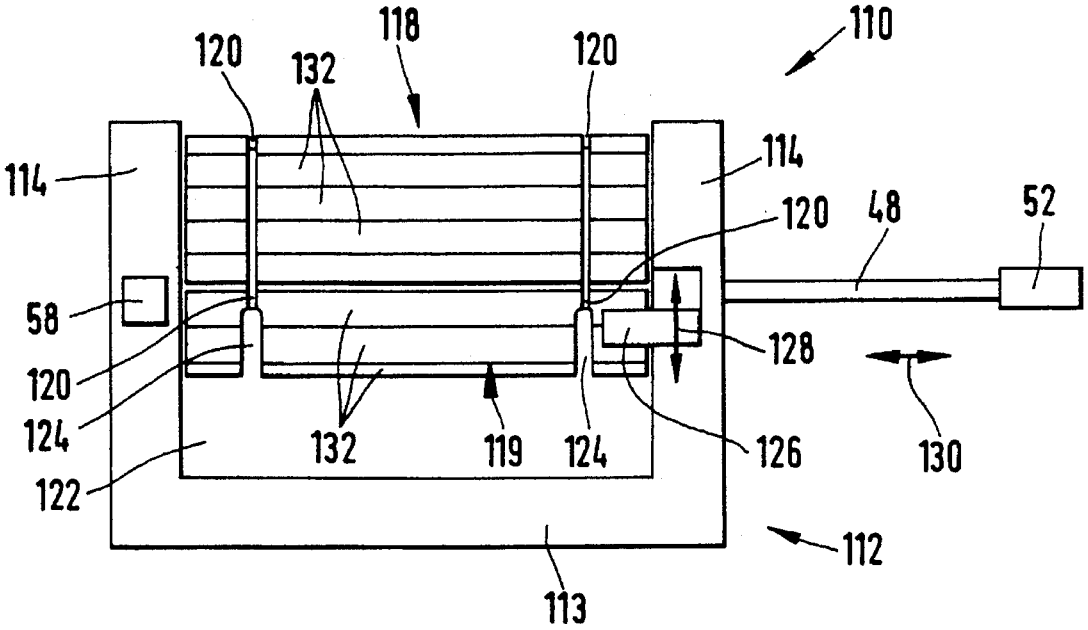
FIG. 6 is a schematic side view of a second embodiment of an apparatus in accordance with the invention.

In FIGS. 6 to 9 a second embodiment of apparatus of this kind is shown. This comprises a housing in the form of a U-shaped stand 112 with a baseplate 113 and two uprights 114. Between the two uprights 114 two grooved cylinders 118, 119 are rotatably mounted, above and parallel to one another as shown in FIG. 6. The distance separating the two grooved cylinders 118, 119 is such that their outer surfaces nearly touch one another. By means of wheel gears inside one of the two uprights 114, not visible in the drawing, the two grooved cylinders 118, 119 are coupled to one another in such a way that when turned they rotate in opposite directions.

In the outer surface of each grooved cylinder 118, 119 are formed longitudinal grooves 132, each approximately semicircular in cross section. The longitudinal grooves 132 in each cylinder are separated from one another by longitudinal ridges. The longitudinal grooves in the two cylinders are separated from the adjacent grooves by the same angular distance. The geared coupling between the two grooved cylinders 118, 119 is such that as the cylinders rotate, between two longitudinal grooves opposite one another in the region of the plane passing through the axes of rotation of the two cylinders there is formed a space approximately circular in cross section, to receive a tobacco-filled strand casing 150. The receptacle 23 so defined is open at both ends. Associated with it at one end is a rod 48 with plunger and handle 52 similar to those of the device 40 as described above, whereas at the other end is disposed an attachment nozzle 60 with clamping mechanism 62, 58 as also described above in connection with the first embodiment. The rod 48 is mounted in one of the two uprights 114, namely that shown on the right in FIGS. 6 and 7, so that it can be displaced axially. The attachment nozzle 60 is correspondingly formed in the other upright 114, and as in the first embodiment it is situated within a recess 158 that is accessible from above.

Figure 7:
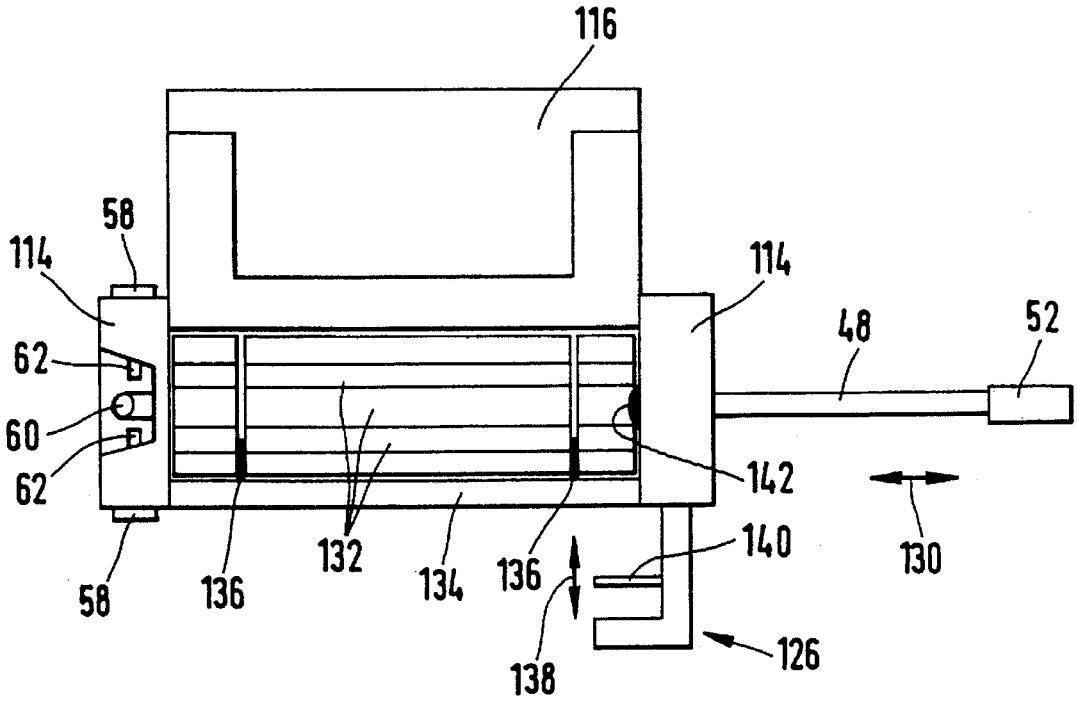
FIG. 7 is a plan view of the apparatus shown in FIG. 6.
Figure 8:
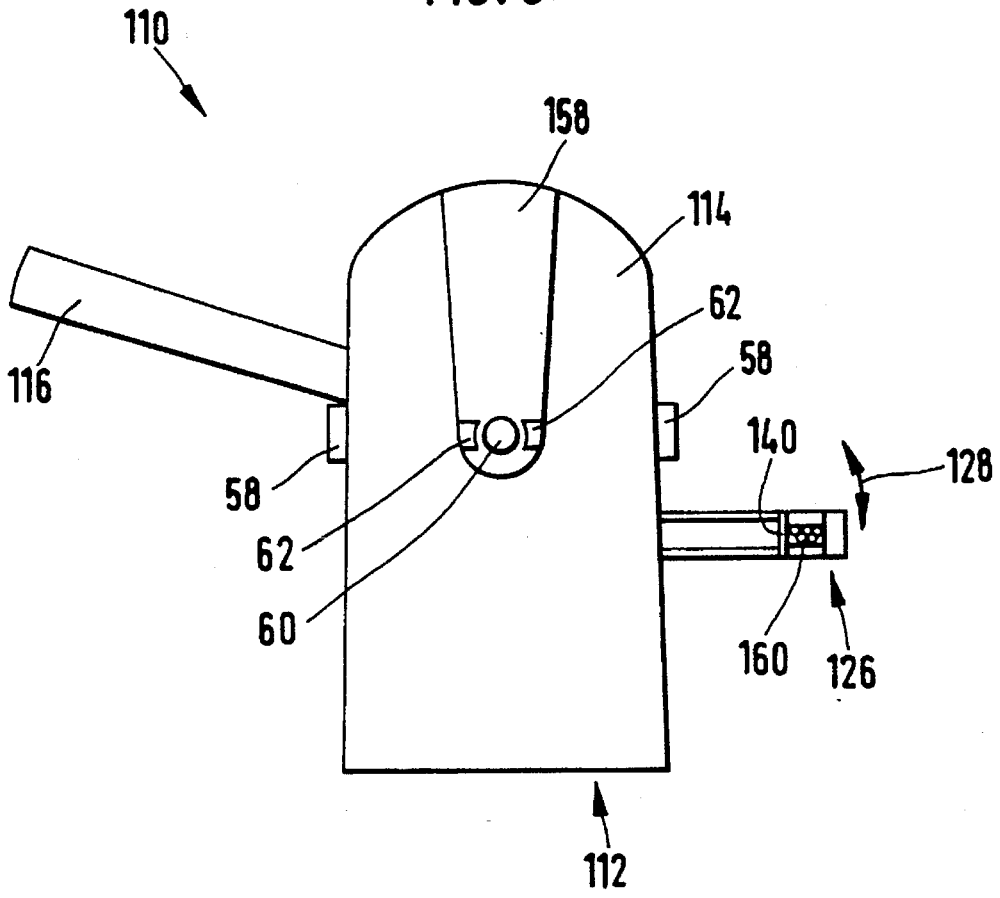
FIG. 8 is a side view of the apparatus shown in FIGS. 6 and 7 from the side associated with an attachment nozzle.
Figure 9:
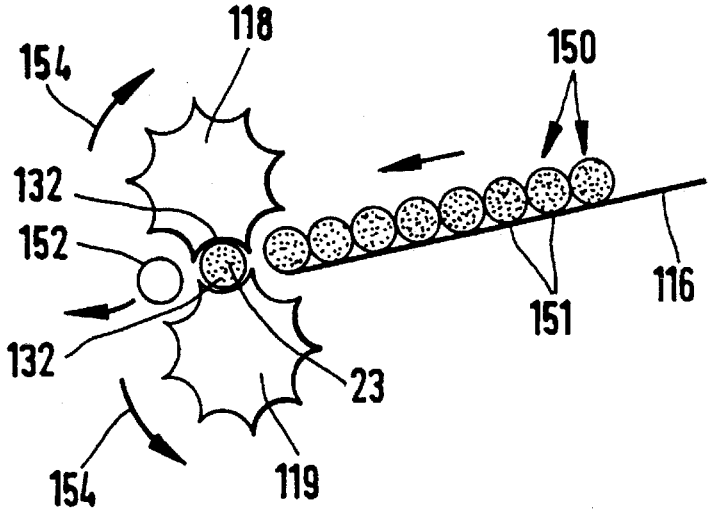
FIG. 9 is a schematic view to show the operation of the apparatus shown in FIGS. 6 to 8.

As can be seen in FIGS. 7 to 9, there is positioned next to the pair of cylinders 118, 119 a magazine 116 that contains a plurality of tobacco-filled strand casings 150 and has the form of a tilted slide, so that as the two grooved cylinders 118, 119 are turned, one tobacco-filled strand casing 150 slides independently out of the magazine 116 into each receptacle 23 defined by longitudinal linear grooves that face one another.

As the receptacle 23 defined by two opposed longitudinal linear grooves 132 is turned further, it encounters strand-cover stripping or ejection elements 124 and 136, which remove the emptied strand casing 150, now lying loose in the receptacle 23, from the longitudinal grooves 132 in the grooved cylinders 118 and 119. The ejection elements 124, 136 each comprise arms that insert into circumferential grooves 120 in the upper and lower grooved cylinders. The ejection elements 124, which are associated with the lower grooved cylinder 119, are formed integrally with a retaining sheet 122 attached to the stand 112. The ejection elements 136, associated with the upper grooved cylinder 118, are formed integrally with a connecting sheet or connecting plate 134 that is mounted between the two uprights 114 of the stand 112.

An actuator, such as a rotatable knob (not shown), is provided which can be engaged with the lower grooved cylinder 119 in order to rotate the latter and hence both grooved cylinders 118, 119. Here, the actuator comprises a pivoted lever 126 that can be brought into engagement with the lower grooved cylinder 119, so disposed that it swings about an axis that coincides with the axis of rotation of the lower grooved cylinder 119. The lever 126 has a locking bar 140 which, urged by a spring 160, engages either the longitudinal grooves 132 of the lower grooved cylinder 119 or the gearwheels of the above-mentioned coupling train, and which can be disengaged against the action of this spring 160. When the locking bar 140 is in the engaged position, by swiveling the pivoted lever 126 the lower grooved cylinder 119 and hence both grooved cylinders together can be rotated until a new receptacle 23 is formed to receive a tobacco-filled strand casing. Then the locking bar 140 is disengaged from the lower grooved cylinder, and hence from the coupling train, so that it can be swung back into the starting position by swiveling the pivoted lever 126. The angle through which the pivoted lever 126 and hence the attached locking bar 140 swings is made such that it causes the grooved cylinders 118, 119 to rotate through an angle that results in the formation of a new receptacle 23 for a tobacco-filled strand casing 150.

To ensure that two longitudinal grooves 132 to form a receptacle 23 are precisely opposed to one another, catch mechanisms 142 can also be provided. In FIG. 7 only one of these is shown, in the form of a spring-loaded ball that engages the end of a longitudinal groove 132 of, in this case, the upper grooved cylinder 118. In this example, the catch mechanism operates by engaging the end of each consecutive longitudinal groove of the upper grooved cylinder 118. The catch mechanism could also be associated with the lower grooved cylinder or with both cylinders. In this example, however, it suffices for it to be associated with only one grooved cylinder because the two cylinders 118, 199 are connected by a gears as described above.

With reference to FIG. 9, the operation of this apparatus will now be described.

First the magazine 116 is filled with a plurality of tobacco-filled strand casings 150 or correspondingly formed rodlike tobacco portions. These tobacco portions can be either separate from one another or connected to form a sort of tobacco cartridge belt. The lowest tobacco portion rests against the two grooved cylinders 118, 119 in such a way that when the cylinders are turned in the direction shown by the arrows 154, as the longitudinal grooves in the two cylinders next to the receptacle 23 come together, a tobacco portion is captured by the longitudinal ridges following the grooves and is carried along. Rotation of the two grooved cylinders 118, 119 is brought about by the pivoted lever 126 and the locking bar 140 associated with it, as described above. The swinging movement of the pivoted lever 126 is indicated in FIG. 6 by the reference numeral 128. To turn the two grooved cylinders 118, 119 in the direction of the arrows 154, the pivoted lever 126 with the locking bar 140 must first be swung upward into the starting position. Then the locking bar 140 is released, so that it moves into its locking position, after which the pivoted lever 126 with locking bar 140 is swung downward, rotating the lower grooved cylinder 119 along with it. Because of the geared coupling, the upper grooved cylinder 118 is rotated correspondingly. As a result, the next tobacco portion from the magazine 116 is brought into the region of the plane passing through the two axes of rotation of the grooved cylinders. In this plane, a longitudinal groove of the lower grooved cylinder 119 and a longitudinal groove of the upper grooved cylinder 118 come into precise alignment facing one another, thus forming a receptacle for the tobacco portion with approximately circular cross section. Within this receptacle 23 the tobacco portion or its strand casing is radially supported, by the opposed longitudinal grooves of the upper and lower grooved cylinders 118, 119. Then the rod 48 is used to push the tobacco out of the strand casing 150, through the attachment nozzle 60 and into the tobacco-receiving space of a cigarette-paper tube that has been placed on the nozzle and fixed there by means of the clamping mechanism 62, 58 described above. After the tobacco has been transferred, the rod 48 is pulled back into its initial position by means of the handle 52. The tobacco-filled cigarette-paper tube is removed from the attachment nozzle. The direction in which the rod 48 is displaced axially by means of the handle 52 is indicated by the double arrow 130 in FIG. 6. When these manipulations have been completed, the grooved cylinders 118, 119 can be rotated one step further by means of the pivoted lever 126 to form a new receptacle 23, containing a new tobacco portion. At this juncture it should be mentioned again that the tobacco portion is defined by a strand casing 150 and a strandlike tobacco filling 151. The strand casing 150 is air-pervious in such a way that the tobacco portion cannot be smoked unless it is contained within a closely apposed cigarette-paper tube.

In the course of the rotation process just described, the emptied strand casing, identified in FIG. 9 by the reference numeral 152, is ejected. This ejection is assisted by the above-mentioned ejection elements 124, 136. After the preceding steps have been repeated several times, the magazine 116 is empty and a corresponding number of cigarettes have been produced.

Figure 10:
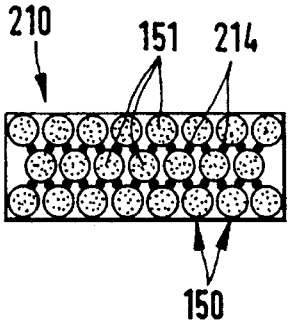
FIG. 10 is a schematic end view of an outer wrapper with strand casings filled with tobacco portions arranged within it.
Figure 11:
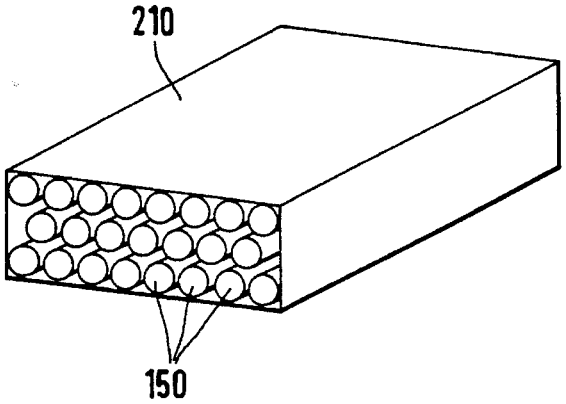
FIG. 11 is a schematic perspective view of the outer wrapper shown in FIG. 10.
Figure 12:
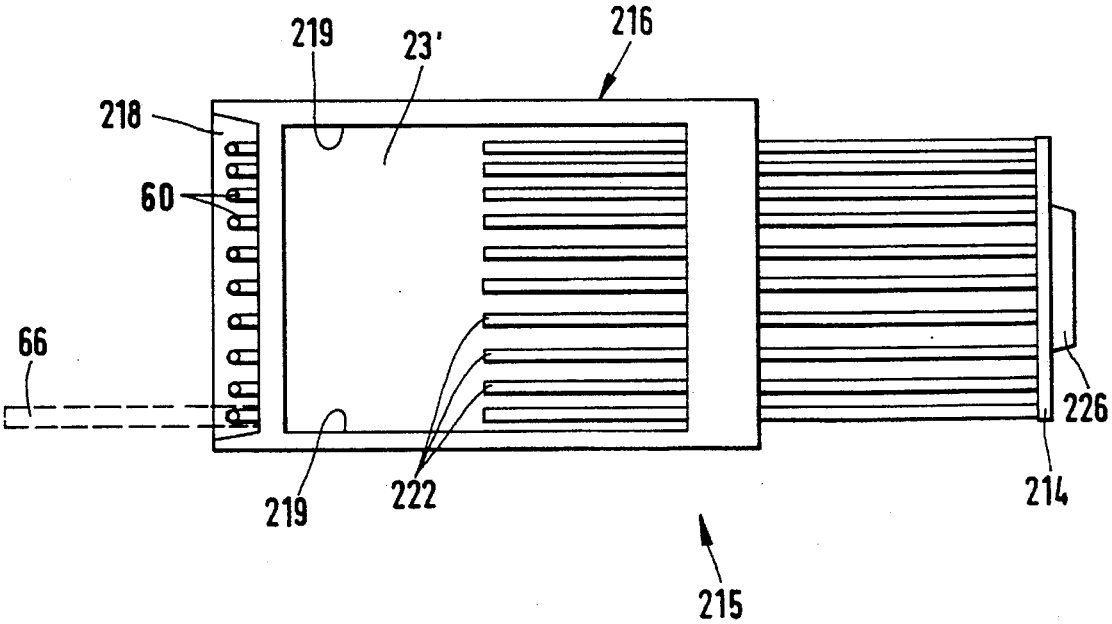
FIG. 12 is a schematic plan view of a third embodiment of apparatus in accordance with the invention for use with tobacco portions in an outer wrapper as shown in FIGS. 10 and 11.

A third embodiment of apparatus for filling or packing cigarette-paper tubes is shown schematically in FIGS. 10 to 12. Here a plurality of tobacco portions or tobacco-filled strand casings 150 are provided, arrayed in parallel so that they lie closely side by side and above one another and enclosed in a box or wrapper 210. The strand casings 150 are preferably attached to one another by adhesive points 214, so that they support one another within the wrapper 210. The outermost strand casings 150 are fixed to the inside of the wrapper 210, preferably also by means of adhesive. The result is a compact structure consisting of a group of tobacco portions of the kind previously described, contained within a wrapper 210. As shown in FIGS. 10 and 11, the box or wrapper 210 is open at the ends. Prior to use, of course, the box or wrapper 210 is closed at the ends, to retain both moisture and aroma.

The said group of tobacco portions is associated with a device 215, shown from above in FIG. 12. This device comprises a receptacle 23' formed in a housing 216 such that the dimensions of the receptacle correspond to the dimensions of the box or wrapper 210. Accordingly, the wrapper 210 including the tobacco portions 150, 151 can be set into the receptacle 23' from above. In one end face of the receptacle 23', at the left in FIG. 12, there are disposed a plurality of bores that pass through the wall of the housing and are adjoined at their outer ends by attachment nozzles 60. Each attachment nozzle is aligned with the position of a tobacco portion inside the box or wrapper 210. Similarly, on the opposite side of the receptacle there is provided a tobacco-transfer device comprising a plurality of rods 222. The latter are axially displaceable in such a way that after a wrapper 210 filled with tobacco portions of the said kind has been positioned in the receptacle 23', they can be moved through the tobacco-filled strand casings 150 as far as the region of the attachment nozzles 60. The number of rods 222 and of attachment nozzles 60 corresponds to the number of tobacco portions 150, 151 arranged in the wrapper 210.

At their ends away from the receptacle 23', the rods 222 are joined together by a yoke-like connecting element 224 with a handle 226 to form a rod-unit, so that the rods 222 can be moved together, i.e. as a whole, through the tobacco-filled strand casings 150. Accordingly, to produce a group of cigarettes cigarette-paper tubes are set onto all the attachment nozzles 60 and held there by means of a clamping wedge or the like. Then a wrapper 210 filled with tobacco portions 150, 151 is opened at its two ends and positioned in the receptacle 23'. The rod-unit is subsequently pushed axially into the receptacle 23', by means of the handle 226. In this process, the tobacco in all the strand casings 150 is simultaneously transferred into the associated cigarette-paper tubes, i.e. into their tobacco-receiving spaces. Afterward the rod-unit is pulled back again until the wrapper 210 is free for removal. The tobacco-filled cigarettes are removed from the attachment nozzles 60, after the described clamping has been released. The mutual support between the strand casings 150 within the wrapper 210 is sufficient to maintain stability for the tobacco-transfer process.

In case the force needed to operate the tobacco-transfer rods 222 should prove excessive, the rod-unit can be supplied with a lever mechanism or the like.

The inner side walls of the receptacle 23' are identified in FIG. 12 by the reference numeral 219. The two narrow side surfaces of the wrapper 210 are positioned adjacent to these.

Figure 13A:
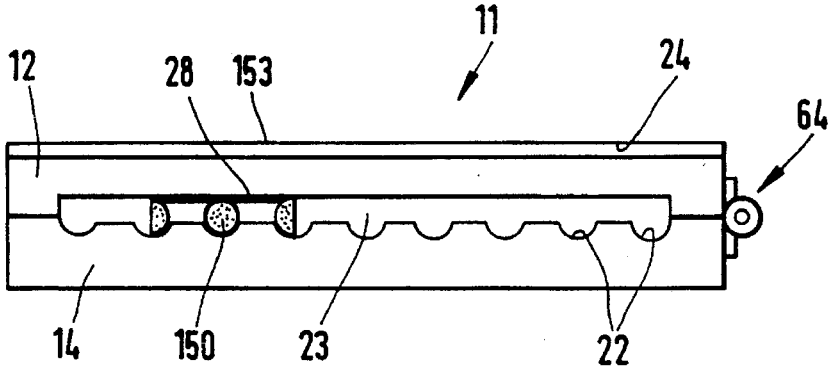
FIG. 13*a* is a side view of a first modification of an apparatus as shown in FIGS. 1 to 5.
Figure 13B:
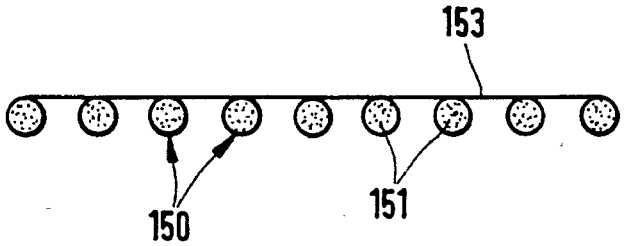
FIG. 13*b* is a side view of a belt of tobacco-filled strand casings for use in the apparatus shown in FIG. 13*a;*

FIG. 13*a* shows in side view with a closed housing a modified embodiment of an apparatus as previously described with reference to FIGS. 1 to 5. This modified embodiment differs from that shown in FIGS. 1 to 5 first in that the inner wall of the receptacle 23 for tobacco-filled strand casings 150 that faces toward the lower housing part 14 is planar. In this modification, this inner wall is the bottom of a flat-bottomed groove formed on the inner surface of the upper housing part 12, which extends parallel to the axis of the hinge joint 64 of the housing. The second difference between the apparatus shown in FIG. 13*a* and that in FIGS. 1 to 5 is that the grooves 22 in the inner surface of the lower housing part 14 are spaced somewhat further apart, to correspond to an arrangement of strand casings 150 filled with tobacco 151 on one side of a strip 153 of paper, plastic or thin cardboard that connects the said strand casings to one another as shown in FIG. 13*b*. The position occupied by such a belt of tobacco-filled strand casings is indicated in FIG. 13*a*.

Figure 14A:
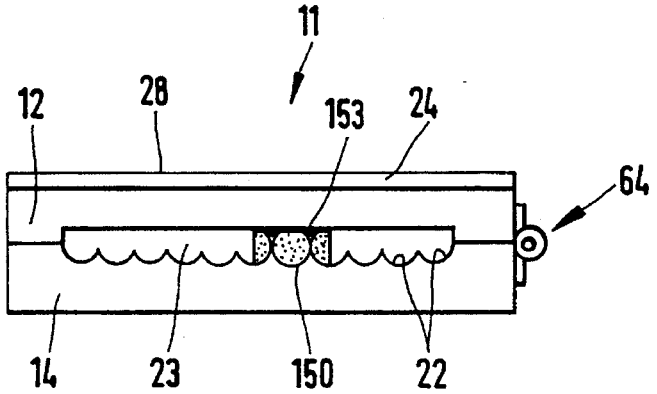
FIG. 14*a* is a side view of a second modification of an apparatus as shown in FIGS. 1 to 5, with a closed housing.
Figure 14B:
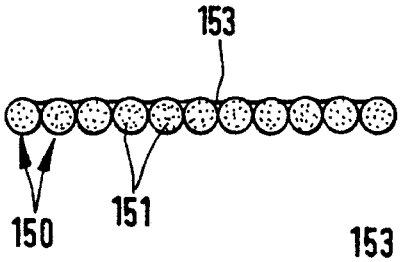
FIGS. 14*b* and 14*c* are respectively a side view and a perspective view from above of a band of tobacco-filled strand casings for use in the apparatus shown in FIG. 14*a*.
Figure 14C:
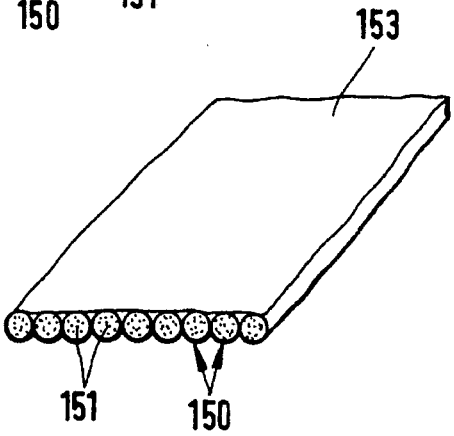

In FIG. 14*a* is shown a construction modified from that according to FIG. 13*a* , such that the grooves on the inner surface of the lower housing part 14 are positioned immediately adjacent to one another. The advantage of this structural modification is that the tobacco-filled strand casings are also closely adjacent when placed within the receptacles 23, which provides additional mutual support at the sides. The corresponding belt of tobacco-filled strand casings is shown in FIGS. 14*b* and 14*c*. Here again, the strand casings 150 filled with tobacco 151 are arranged on one side of a connecting strip 153, preferably by being glued thereto. It is also possible for the individual strand casings to be glued together along their lines of contact, at least at certain points. In the extreme case, in which the tobacco-filled strand casings are glued together directly along their full length, the connecting strip 153 can be eliminated. It is necessary merely to ensure that a handling unit comprises at least two tobacco-filled strand casings connected to one another, which, as shown in FIG. 14*a*, can be placed into an apparatus such as is shown in FIG. 14*a*.

The connection of at least two tobacco-filled strand casings together offers the advantage of easier, in particular more rapid, placement within apparatus as shown in FIGS. 13*a* or 14*a*. The procedure by which individual tobacco-filled strand casings are positioned within the receptacles 23 of the tobacco-transfer apparatus is described above with reference to the apparatus as shown in FIGS. 1 to 5. It is of course also possible to use a belt of tobacco-filled strand casings with the apparatus according to FIGS. 1 to 5. In that case it is necessary only that the connecting strip between adjacent strand casings lie approximately in the plane passing through their centers.

Finally, reference will be made to a further structural modification of the apparatus shown in FIGS. 1 to 5 that is shown in schematic side view in FIG. 15*a*. In this apparatus the receptacle 23 is bounded on all sides by planar walls. In this case the receptacle 23 is formed by flat-bottomed grooves extending parallel-to the axis of the hinge joint 64 of the housing in the two surfaces of the upper and lower housing parts 12 and 14 that face one another. It is also conceivable to provide a somewhat deeper flat-bottomed groove in the inner surface of only one housing part, the upper or the lower, while the associated boundary wall on the inner surface of the other housing part is entirely planar.

Figure 15A:
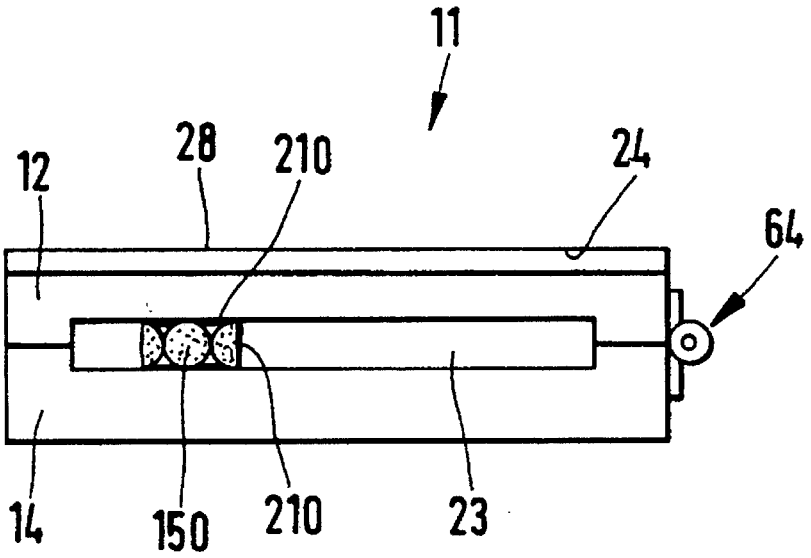
FIG. 15*a* is a side view of a third modification of an apparatus as shown in FIGS. 1 to 5 with a closed housing.
Figure 15B:
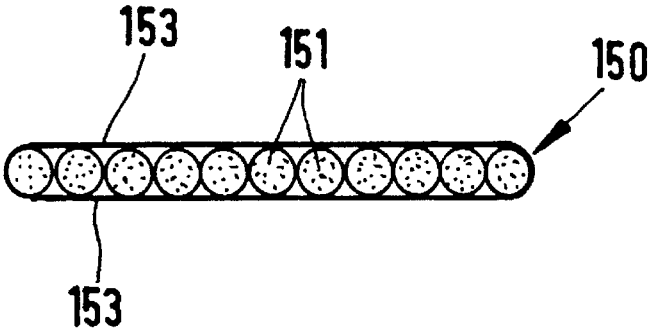
FIGS. 15*b* and 15*c* are each side views of two different versions respectively of a belt of tobacco-filled strand casings for use in the apparatus shown in FIG. 15*a*.
Figure 15C:
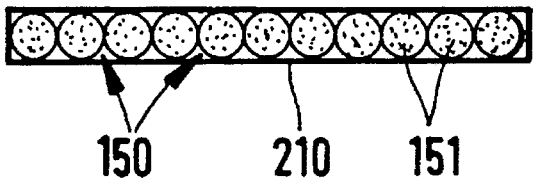

FIGS. 15*b* and 15*c* are end views of belts of strand casings 150 filled with tobacco 151 designed to be particularly advantageous for use with the apparatus according to FIG. 15*a*. In these examples, each strand belt comprises eleven tobacco-filled strand casings. Such a handling unit can of course be of various sizes. Preferably each strand belt will comprise 7, 10 or 12 tobacco-filled strand casings or tobacco portions. These sizes are relatively easy to handle; that is, they can be placed with no great problems into the receptacle 23 of an appropriate apparatus, for example the apparatus according to FIG. 15*a*.

The strand-cover belt as shown in FIG. 15*b* is characterized by the fact that the tobacco-filled strand casings are arranged between an upper and a lower connecting strip 153 made of plastic, paper or thin cardboard, to which they are connected, in particular by adhesive. In addition or alternatively, it is conceivable for the tobacco-filled strand casings to be glued to one another along their contact lines.

In the embodiment shown in FIG. 15*c*, the strand casings 150 filled with tobacco 151 are placed within a tube-like wrapper 210. The wrapper 210 has the shape of a flat block. Before use, of course, the ends of this wrapper 210 are closed. When the tobacco is to be transferred as described above, the end faces of the wrapper are removed. Then the wrapper, together with the tobacco-filled strand casings, is set into the receptacle 23 of the apparatus according to FIG. 15*a*. By means of the tobacco-transfer element described above, the tobacco can then be transferred into the associated cigarette-paper tubes.

At this juncture it should also be pointed out that axial displacement of the strand casings 150 as the tobacco is being transferred into the tobacco-receiving space of an associated cigarette-paper tube is prevented by the tobacco-transfer device, in particular by its side pieces 44.

In the embodiments shown in FIGS. 13*a* and 14*a* troughlike catch depressions 26 are provided on the upper surface of the upper housing part 12, each associated with one of the channel-like grooves 22 on the inner surface of the lower housing part 14, just as in the embodiment described with reference to FIGS. 1 to 5. In the embodiment shown in FIG. 15*a* the distance between neighboring troughlike catch depressions 26 in each row of depressions is determined by the distance between the centers of the individual tobacco-filled strand casings in the strand belt being used in the particular case.

So that the apparatus described above with reference to FIGS. 6 to 9 can also be used in connection with a strand belt as shown in FIGS. 13*b*, 14*b* and/or 15*b*, the ridges between adjacent longitudinal grooves 132 are formed as severance elements, in particular cutting edges, so that as a tobacco-filled strand casing is pulled into the receptacle 23, the connecting strip 153 between this tobacco-filled strand casing and the next tobacco-filled strand casing is severed.

Given suitable dimensioning of the longitudinal grooves 132 and the ridges between adjacent longitudinal grooves 132, and also of the connecting strip 153, it is in principle also possible for the tobacco-filled strand casings to be drawn consecutively into the receptacle 23 and ejected from it after the tobacco has been transferred without severing the connecting strip. In this case the connecting strip helps to keep the tobacco-filled strand casings the right distance apart during transport, corresponding to the angular distance separating the longitudinal grooves 132.

What is claimed is:

1. A method of filling a cigarette-paper tube open at least on one end with tobacco from a pre-portioned tobacco filled strand casing open at both ends and filled with a tobacco strand, and comprising the steps of positioning the cigarette-paper tube with the open end adjacent one open end of the tobacco-filled strand casing and supporting the cigarette paper tube adjacent the tobacco filled tobacco strand, at least partially radially supporting the strand casing in overlying relation to the tobacco strand and holding the casing against movement without interfering with movement of the tobacco strand; and pushing the tobacco strand out of the strand casing and into the associated cigarette-paper tube using a plunger means.

2. An apparatus for filling a cigarette-paper tube having an open end with tobacco comprising a tobacco strand casing of a substantially sound and constant diameter and filled with an elongated and tubular tobacco strand, a housing including at least one tubular receptacle open at both ends and defining first and second open ends for receiving said tobacco strand casing, said receptacle and said tobacco strand having the same cross-section, a nozzle connected to said housing to which an open end of the cigarette-paper tube can be attached, said nozzle connected to the first open end of said receptacle, a plunger means mounted on the housing and aligned with the second open end of said receptacle, said plunger means being displaceable through said receptacle and having a diameter for passing through said casing and transferring said tobacco strand out of the strand casing and through the nozzle and into the cigarette-paper tube attached to the nozzle;

support means within the receptacle engaging the outer surface of said strand casing and for externally and radially supporting said strand casing over at least a portion of said tobacco during the transfer of the tobacco strand from the casing into the cigarette-paper tube.

3. The apparatus of claim 2 wherein the receptacle comprises an inner wall engaging the outer surface of said tobacco casing, said wall having a roughened surface.

4. The apparatus of claim 2 wherein said housing includes a plurality of receptacles arranged in parallel side-by-side relationship, a tobacco strand supply including said tobacco strand casing and a plurality of additional tobacco strand casings, said strand casings being connected together and forming a belt with tobacco strand casing in the same alignment as said receptacles, said support means radially supporting each of said individual strand casings.

5. The apparatus of claim 4 wherein each of said receptacles includes an inner roughened wall engaging said casing within said receptacle.

6. The apparatus of claim 2 wherein said nozzle includes a clamping means clamping the cigarette-paper tube to the nozzle during the transfer of said tobacco strand.

7. The apparatus of claim 2 wherein the housing comprises a lower housing portion and an upper housing portion, a connecting joint releasably connecting said housing portion together and said housing portions having opposing surfaces, said opposing surfaces including recesses forming said receptacle.

8. The apparatus of claim 7 wherein said opposing surfaces include a plurality of additional opposing recesses forming a plurality of additional receptacles parallel to each other and to said first named receptacle, said opposed surfaces including ridges separating said receptacles.

9. The apparatus of claim 8 wherein said opposing recesses include smooth inner walls, said receptacles being adapted to receive a plurality of tobacco-filled strand casings spaced in accordance with said receptacles and connected together by connecting webs between said casings in the form of a belt.

10. The apparatus of claim 8 wherein said plunger means and said nozzle are displaceably mounted to the housing for selective alignment with each of said receptacles.

11. The apparatus of claim 10 wherein said housing includes a catch means aligned with each of said receptacles for releasably attaching said plunger means and said nozzle to the receptacles.

12. The apparatus of claim 10 wherein one of the housing and said plunger means includes guide rails and the other of the housing and the plunger means defines guide slots co-operable with the guide rails whereby the plunger means can be linearly displaced along the housing into selective alignment with the receptacles.

13. The apparatus of claim 2 comprising two grooved and elongated cylinders rotatably disposed within the housing and having closed spaced opposed surfaces, said surfaces having elongated and aligned linear grooves, and a coupling and drive means for the cylinders whereby they are coupled to one another and are rotatably driven in opposite directions with opposing linear grooves successively aligned to form said receptacles.

14. The apparatus of claim 13 wherein the cross sectional profile of each longitudinal groove is substantially semicircular and said two opposed grooves form said receptacle.

15. The apparatus of claim 13, comprising a magazine holding a plurality of said tobacco-filled strand casings, means for securing the magazine to the cylinders and transferring one tobacco-filled strand casing from the magazine into each receptacle defined from the magazine into each receptacle defined in response to rotating said cylinders.

16. The apparatus of claim 13, wherein said cylinders each include a plurality of said grooves, each two adjacent linear grooves of each cylinder being separated from one another by a ridge defining a cutting edge, a strand unit having a plurality of strand filled casings, said unit being movable to insert one strand into the aligned grooves, said ridges severing the casing located in the receptacle from the adjacent strand casing.

17. The apparatus of claim 13 comprising an ejection means removing of an emptied strand casing from the linear grooves of the cylinders after rotation of the cylinders opening the receptacle containing said emptied casing.

18. The apparatus of claim 13 including an actuator engageable with at least one of the two grooved cylinders to rotate said cylinders.

19. The apparatus of claim 18 wherein the actuator comprises a lever engaged with one of the grooved cylinders.

20. The apparatus of claim 19 wherein the level is releasably engaged with the grooved disengaged cylinder, a spring-loaded unit having an axis of rotation which coincides with the axis of rotation of the cylinder and connected to lever the urge of the lever into engagement with the cylinder.

21. The apparatus of claim 13 wherein the housing and at least one of the grooved cylinders includes a complementary catch means releasably locking the cylinders into position with said two linear grooves opposing one another to form said receptacle.

22. The apparatus of claim 2 wherein the housing includes a plurality of additional receptacles arranged in parallel and closely adjacent to each other, a plurality of nozzles attached to the housing and aligned one with each receptacle, and a plurality of plunger means mounted to the housing and aligned with receptacles and said nozzles.

23. The apparatus of claim 22 including a magazine of tobacco-filled strand casings are connected to one another in groups corresponding to the receptacles in said housings.

24. The apparatus of claim 22 including a coupling means connected to said plurality of plunger means and simultaneously moving of the plunger means.

25. The apparatus of claim 22 wherein the receptacles having a selected spacing for receiving a magazine including a plurality of tobacco-filled strand casings connected to said other with a corresponding spacing.

* * * * *